US006364630B1

(12) United States Patent
Craft et al.

(10) Patent No.: US 6,364,630 B1
(45) Date of Patent: Apr. 2, 2002

(54) VANE PUMP

(75) Inventors: Royston Brian Craft, Gillingham; Christopher Wood, Rainham, both of (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/518,738

(22) Filed: Mar. 3, 2000

(30) Foreign Application Priority Data

Mar. 6, 1999 (GB) ..... 9905162

(51) Int. Cl.[7] ..... F04B 49/00; F04B 23/00
(52) U.S. Cl. ..... 417/310; 417/440; 417/283
(58) Field of Search ..... 417/310, 440, 417/283, 307, 296

(56) References Cited

U.S. PATENT DOCUMENTS

| | | | | |
|---|---|---|---|---|
| 2,585,406 A | | 2/1952 | Reynolds | 418/1 |
| 2,631,540 A | | 3/1953 | Baugh | 417/310 |
| 3,680,980 A | * | 8/1972 | Bart | 417/310 |
| 4,183,723 A | * | 1/1980 | Hansen et al. | 417/310 |
| 4,201,170 A | * | 5/1980 | Overfield | 417/456 |
| 4,564,338 A | * | 1/1986 | Ilg | 417/310 |
| 4,738,596 A | * | 4/1988 | Abinett et al. | 417/252 |
| 5,720,603 A | | 2/1998 | Miller | 418/180 |
| 5,722,815 A | * | 3/1998 | Cozens | 417/310 |
| 6,112,718 A | * | 9/2000 | Bond | 123/310 |

FOREIGN PATENT DOCUMENTS

| | | |
|---|---|---|
| DE | 35 33 952 | 4/1987 |

* cited by examiner

*Primary Examiner*—Charles G. Freay
*Assistant Examiner*—Michael K. Gray
(74) *Attorney, Agent, or Firm*—Thomas A. Twomey

(57) ABSTRACT

A vane pump, having an inlet for receiving fuel and an outlet from which fuel is supplied, comprising a generally cylindrical member, a driven rotor arranged within the cylindrical member and a closure member. The cylindrical member and the closure member co-operate to define a recirculation passage interconnecting the outlet and the inlet, the output pressure of fuel discharged from the pump being regulated by a resiliently biased valve means controlling the flow of fuel through said recirculation passage.

6 Claims, 3 Drawing Sheets

VANE PUMP

TECHNICAL FIELD

The invention relates to a vane pump for supplying fuel, the pump having associated means for regulating the pressure of fuel supplied by the vane pump. In particular, the invention relates to a vane pump for supplying fuel under pressure to a fuel injection pump.

BACKGROUND OF THE INVENTION

In diesel engines, it is usual to use a transfer pump to supply fuel under pressure to a diesel fuel injection pump. The fuel pressure supplied to the fuel injection pump must be regulated and, in mechanically driven fuel injection pumps, this can be done by using a rotary vane pump as the transfer pump. An associated pressure regulator serves to control the fuel pressure supplied to the fuel injection pump from the outlet of the vane pump.

One type of conventional vane pump comprises a driven rotor arranged within a cylindrical member, commonly referred to as a liner, the liner having a non circular bore arranged eccentrically to the centre line of the driven rotor. The rotor rotates within the liner between two closure plates, an upper closure plate, commonly referred to as the distribution plate, and a lower plate. Apertures within the upper and lower closure plates define an inlet port and an outlet port within the vane pump housing.

Fuel is introduced into the vane pump through the inlet port and is carried around the pump by means of blades extending from the rotor and biased towards the inner surface of the liner. Fuel from the outlet port is supplied to a regulator arranged remotely from the vane pump which serves to regulate the fuel pressure supplied to a downstream fuel injection pump by recirculating some of the fuel from the vane pump outlet back into the vane pump inlet.

The regulator usually consists of a cylindrical body housing a spring biased piston. It is necessary to form several drillings within the regulator body to accommodate the piston and to provide the channels required to effect the regulatory function of the device. Where the regulator body is within a housing common to the vane pump and/or the fuel injector pump itself, it is also necessary to form additional drillings in the housing. The construction of a conventional vane pump is therefore complex and manufacture is difficult and expensive. In addition, the device can be bulky as the regulator is arranged remotely from the rotary part of the vane pump.

It is an object of the present invention to provide a vane pump of reduced complexity which alleviates the manufacturability problems of the prior art. It is a further object of the present invention to provide a vane pump which has a reduced size.

According to the present invention, there is provided a vane pump, having an inlet for receiving fuel and an outlet from which fuel is supplied, comprising;

- a generally cylindrical member;
- a driven rotor arranged within the cylindrical member; and
- a closure member, the cylindrical member and the closure member co-operating to define a recirculation passage interconnecting said outlet and said inlet, the output pressure of fuel discharged from the pump being regulated by resiliently biased valve means controlling the flow of fuel through said recirculation passage.

In one embodiment of the invention, the closure member may form part of the pump housing.

The cylindrical member may have a first channel defined therein co-operating with a second channel defined in the closure member, the first and second channels defining the recirculation passage.

Alternatively, the recirculation passage may be defined by a channel formed in the cylindrical member, the closure member cooperating with the cylindrical member to define an inner surface of the recirculation passage.

As the only machinings required for the regulatory function are the first and second channels within the closure member and the cylindrical member, the vane pump of the invention is considerably less complex than a conventional vane pump, therefore providing advantages in terms of manufacturing difficulty and cost. Additionally, as the means for regulating the fuel pressure are arranged within the cylindrical member and closure member assembly, the vane pump is of reduced size.

The valve means may be in the form of a compression spring housed within the recirculation passage, the spring biasing an abutment member into communication with an opening of the recirculation passage to control the flow of fuel supplied to the recirculation passage. Conveniently, the abutment member may be a ball.

In an alternative embodiment, the biasing means may be a leaf spring biased into communication with an opening of the recirculation passage to control the flow of fuel supplied to the recirculation passage. In a further alternative embodiment, the vane pump may comprise a third passage defined within the cylindrical member and communicating with the recirculation passage, the supply of fuel to the third passage being regulated by means of a piston member operating under a spring biasing force. This embodiment is particularly useful for supplying fuel to a mechanically driven fuel injection pump, requiring a speed dependent fuel pressure.

BRIEF DESCRIPTION OF THE DRAWINGS

The invention will now be described, by way of example only, with reference to the following drawings in which.

DESCRIPTION OF THE PREFERRED EMBODIMENTS

Figure 1:
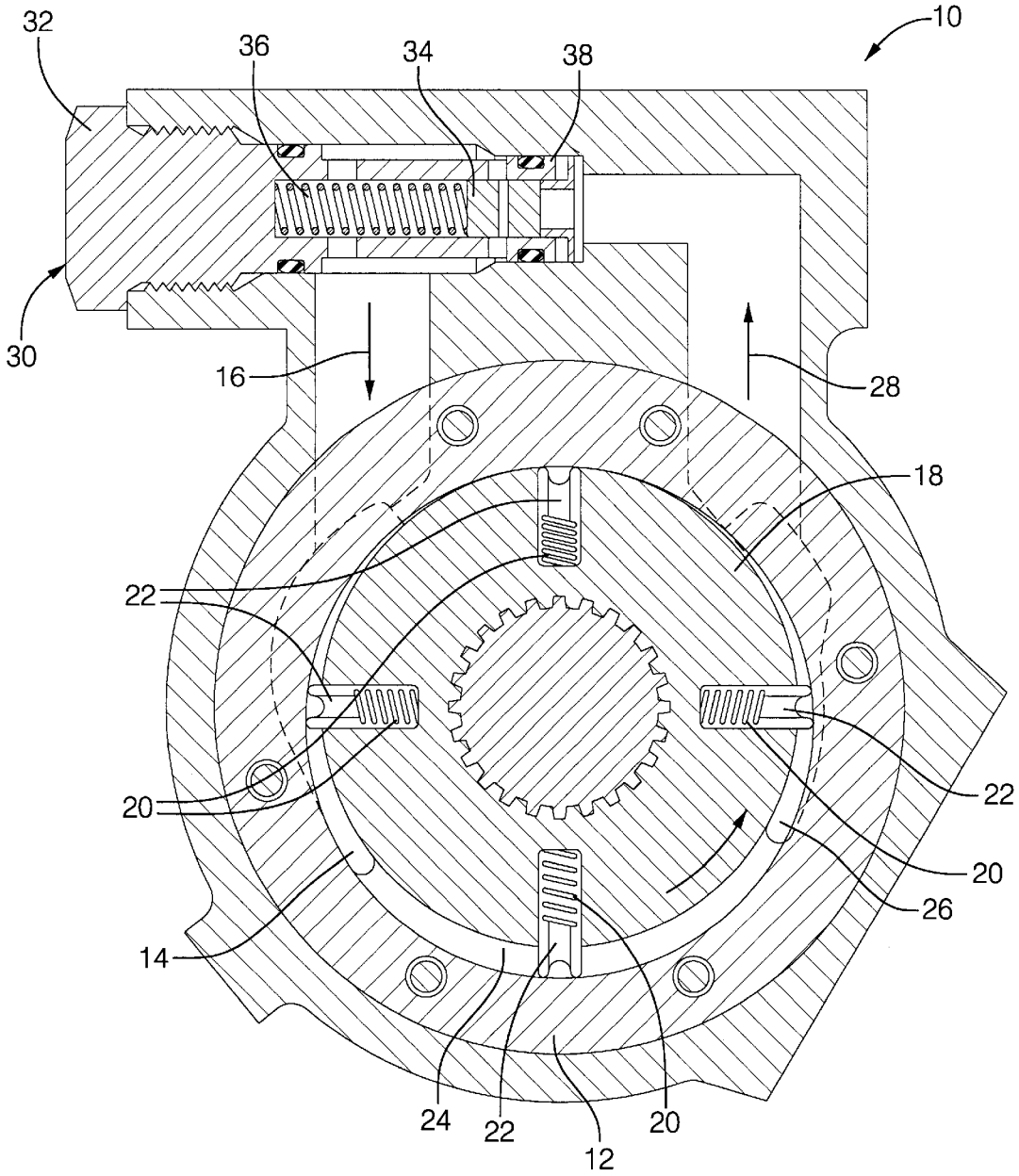
PRIOR ART FIG. 1
FIG. 1 is a diagram of a conventional vane pump, including a regulator for regulating the fuel pressure supplied by the vane pump.

With reference to FIG. 1, a conventional vane pump, referred to generally as 10, comprises a cylindrical liner 12 and an inlet port 14 for receiving fuel from an associated fuel tank (i.e. in the direction of arrow 16). The pump also comprises a rotor 18 which is usually driven by the driveshaft driving an associated fuel injection pump (not shown) to which the vane pump supplies fuel. The rotor 18 carries blades 20 maintained in contact with the inner surface of the liner 12 by means of a spring 22; fuel pressure at their radially inner ends, centripetal forces, or a combination of all three. Fuel is introduced at the inlet 14 and, as the blades 20 are rotated past the inlet 14, fuel becomes trapped in a gap 24 between the liner 12 and the rotor 18 and fuel is carried by the blades 20 as the rotor 18 rotates.

Eventually, the blades uncover an outlet port 26 such that fuel is expelled from the vane pump in the direction of arrow 28. Fuel is then either supplied to the downstream fuel injection pump or is returned to the vane pump inlet 14 through a regulator 30. The regulator 30 serves to regulate the fuel pressure supplied to the fuel injection pump by returning some of the fuel expelled from the outlet 26 to the inlet 14.

The regulator 30 comprises a body 38, housing a piston 34 biased by a spring 36, and a retention cap 32. In order to construct the regulator 30 it is necessary to form several drillings in the regulator body 38 and also in the fuel injection pump downstream. Thus, the construction of the vane pump is complex and manufacture is difficult. The vane pump arrangement, including the regulator, is also rather bulky.

Figure 2:
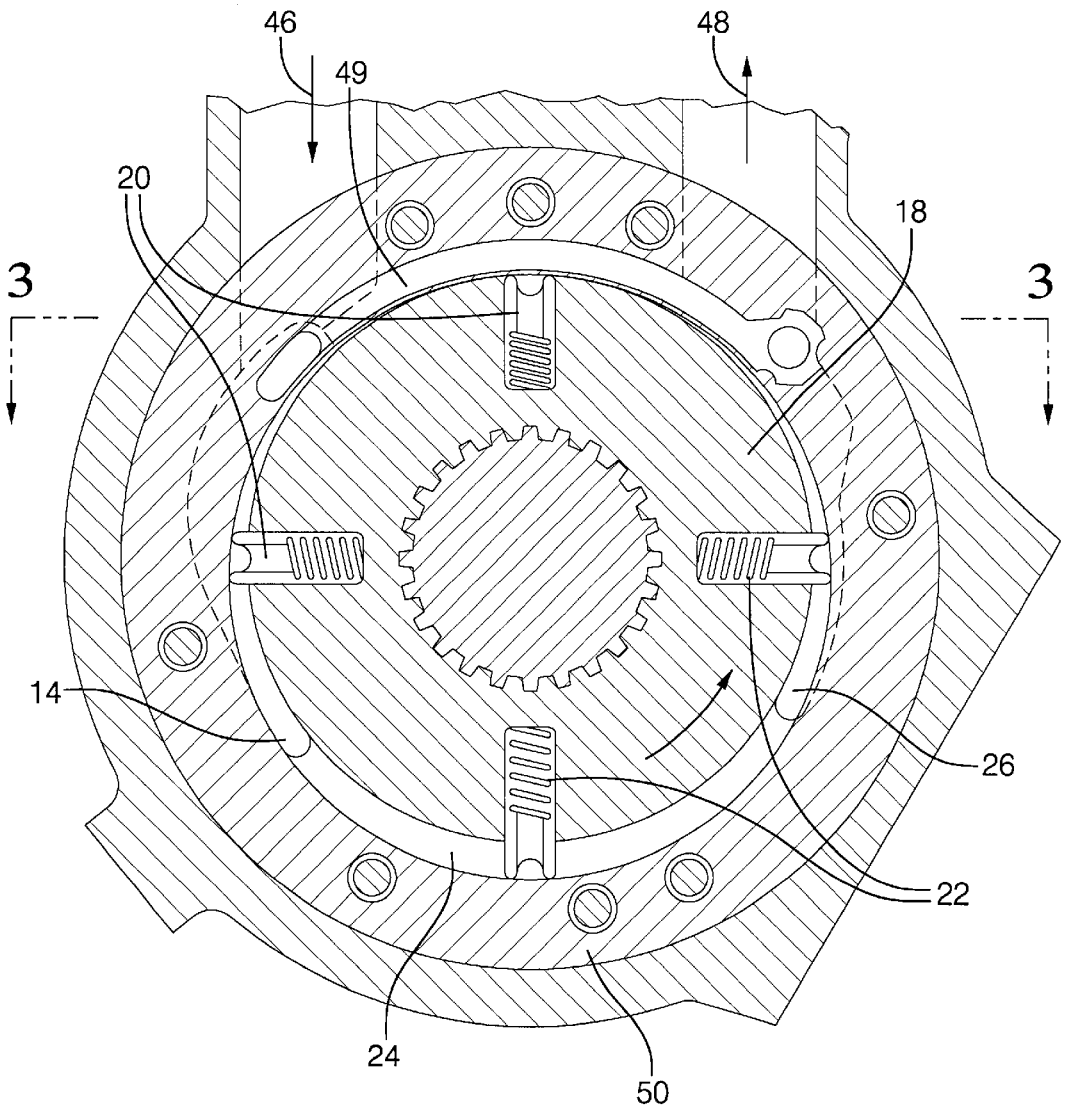
FIG. 2 is a diagram of a vane pump in accordance with one embodiment of the present invention.
Figure 3:
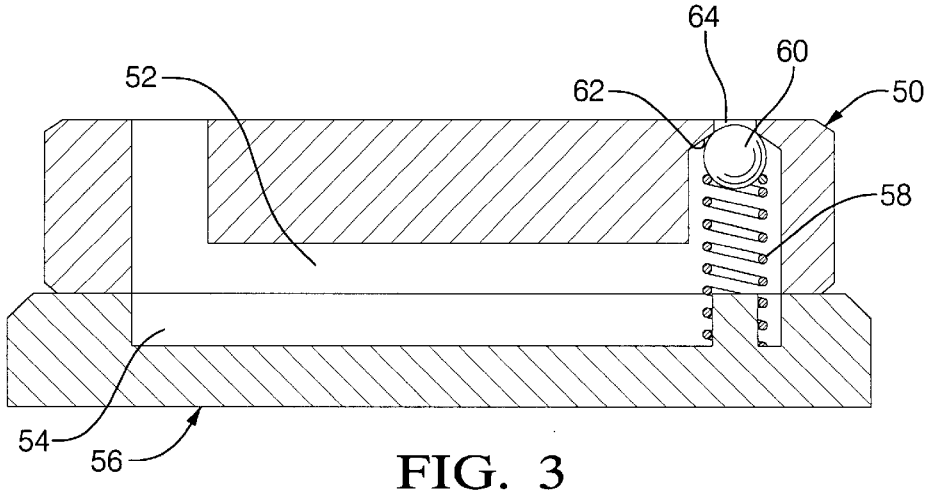
FIG. 3 is a cross-sectional view on a line X—X of the vane pump shown in FIG. 2.

FIG. 2 illustrates a vane pump of the present invention, into which fuel is introduced at the inlet 14, as indicated by arrow 46. The vane pump comprises a rotary member 18 carrying blades 20 biased into contact with the inner surface of a cylindrical member 50, commonly referred to as the vane pump liner. The liner 50 has a non circular bore arranged eccentrically to the centre line of the rotor 18. The inlet 14 and the outlet 26 may be defined in an upper closure plate or closure member (not shown in FIG. 2), commonly referred to as a distribution plate, facing the closure member or closure plate 56 (as shown in FIG. 3) and located on the opposite side of the rotor 18 to the closure plate 56. Alternatively, the inlet 14 and the outlet 26 may be defined by apertures in the upper and lower closure plates. In addition, a partial inlet and outlet may be defined within the liner 50.

The blades 20 carried by the rotor 18 are biased into contact with the liner 50 by means of a spring 22, fuel pressure at their radially inner ends, centripetal forces, or a combination of all three. As the blades 20 move with the rotor 18 past the inlet 14, fuel becomes trapped in the gap 24 defined by the liner 50 and the rotor 18 between adjacent blades 20. Due to the shape of the liner 50, fuel is expelled through the outlet 26 when blade rotation causes the outlet 26 to be uncovered. Fuel expelled from the outlet 26 either exits the vane pump, in the direction of arrow 48, to a fuel injection pump located downstream (not shown) or is recirculated back to the inlet 14 by means of a recirculation passage 49 defined partly within the liner 50.

The construction of the recirculation passage 49 can be seen more clearly in FIG. 3 which shows a cross-sectional view on the line X—X of the vane pump shown in FIG. 2. The liner 50 is cooperably engaged with a lower closure plate 56. The liner 50 has a channel or groove 52 defined therein, the channel 52 being formed in the axial end-face of the liner 50. The closure plate 56 has a channel or groove 54 defined in its uppermost face which, together with the channel 52, defines the recirculation passage 49 for fuel at the vane pump outlet 26. A spring 58 is housed within the recirculation passage 49 and biases a ball 60 into a seating 62 such that the ball 60 closes an opening 64 to the channel 52, thus preventing the flow of fuel into the channel 52, and hence the recirculation passage 49, from the outlet 26.

At a predetermined pressure of fuel at the outlet 26, acting on the ball 60 through the face of the opening 64, the force of the spring 58 is overcome and the ball 60 is moved out of the seating 62 allowing fuel to flow through the passage 49 from the pump outlet 26, thus serving to regulate the amount of fuel recirculated to the pump inlet 14. As the fuel pressure at the outlet 26 decreases, the force applied to the ball 60 is reduced and, when the biasing force of the spring 58 overcomes the force of the fuel pressure, the spring 58 biases the ball 60 into communication with the seating 62 so that the opening 64 is closed to fuel. The spring-biased ball 60 therefore provides regulatory control of fuel entering the recirculation passage 49 and recirculating back to the inlet 14. Fuel which does not enter the recirculation passage 49 is expelled from the outlet 26 (in the direction of arrow 48 in FIG. 2) for supply to the fuel injection pump downstream.

The arrangement of the recirculation passage 49 within the cylindrical liner 50 and the closure plate 56, and the spring-biased ball 60 provides a simplified means of regulating the fuel pressure supplied by the vane pump. In particular, channels 52,54 in the cylindrical liner 50 and the closure plate 56 are simpler to form than the complex arrangement of passages required in a conventional regulator.

Figure 4:
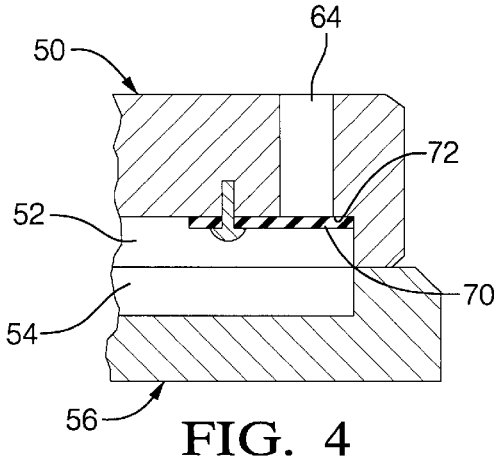
FIGS. 4 and 5 are similar cross-sectional views to FIG. 3 of first and second alternatives.

A second embodiment of the invention is shown in FIG. 4 and comprises a leaf spring 70 housed within the channel 52 of the liner 50. The leaf spring is biased into contact with a seating 72 within the channel 52 and serves to regulate the amount of fuel recirculating back through the recirculation passage 49 in a similar way as described in relation to FIG. 3. Thus, when the pressure of fuel at the vane pump outlet 26, and thus opening 64, overcomes the biasing force of the leaf spring 70, the spring 70 is moved away from the seating 72 to allow fuel to enter the recirculation passage 49. In this way, the pressure of fuel expelled from the vane pump to the fuel injection pump downstream can be regulated.

Figure 5:
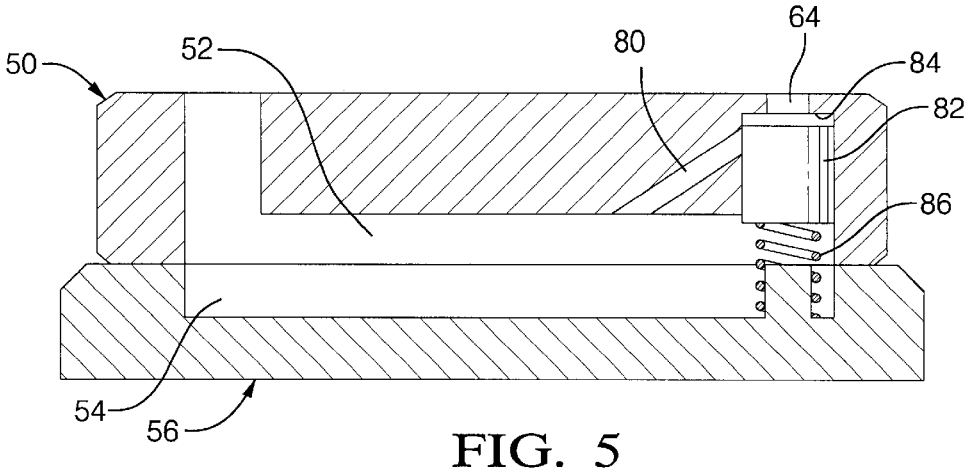

A third embodiment of the invention is shown in FIG. 5, in which regulation of fuel pressure is provided by means of a piston member 82, or plunger, biased into contact with a seating 84 defined in the channel 52 by means of a spring 86. As the fuel pressure at the outlet 26 of the vane pump increases, the force applied to the end-face of the piston 82 increases until, when the spring force is overcome and the piston 82 is moved away from the seating 84, fuel is able to enter a secondary passage 80, defined in the body of the cylindrical liner 50, the passage 80 being in fluid communication with the recirculation passage 49.

The degree of movement of the piston 82 away from the seating 84 provides graduated regulatory control of fuel entering the secondary passage 80. The spring-biased piston 82 thereby serves to control the amount of fuel recirculating through the recirculation passage 49 to the inlet 14 of the vane pump, thus regulating the fuel pressure supplied by the vane pump to the fuel injection pump downstream.

The embodiment shown in FIG. 5 is particularly suitable for supplying fuel to a mechanically controlled fuel injection pump requiring a speed dependent pressure signal, such as may be used for advance control and inlet metering purposes.

It is envisaged that other forms of biasing means may be provided within the recirculation passage 49 to control the amount of fuel recirculated to the inlet 14 and the invention need not be limited to the embodiments hereinbefore described.

It will be appreciated that the recirculation passage 49 need not be defined by channels or grooves formed in both the cylindrical liner 50 and the closure plate 56, but may be defined by a single channel in the cylindrical liner 50, the closure plate 56 defining an inner surface of the recirculation passage 49 by means of its engagement with the axial end-face of the liner 50. Thus, the surface of the closure plate 56 closes the channel in the cylindrical member to define the recirculation passage 49 with the channel formed in the liner 50. A recirculation passage formed in this way is suitable for use with lower fuel flow rates, or if a wider recirculation passage is employed, for example if the outer diameter of the liner is relatively large.

What is claimed is:

1. A vane pump, having an inlet for receiving fuel and an outlet from which fuel is supplied, comprising:

a generally cylindrical member;

a driven rotor arranged within the cylindrical member; and a closure member, the cylindrical member and the closure member co-operating to define a recirculation passage interconnecting the outlet and the inlet, the output pressure of fuel discharged from the pump being regulated by a resiliently biased valve controlling the flow of fuel through said recirculation passage, wherein the cylindrical member has a first channel defined therein co-operating with a second channel defined in the closure member, the first and second channels defining the recirculation passage, wherein the recirculation passage is defined by a channel formed in the cylindrical member, the closure member cooperating with the cylindrical member to define an inner surface of the recirculation passage.

2. The vane pump as claimed in claim 1, wherein the valve takes the form of a compression spring housed within the recirculation passage, the spring biasing an abutment member into communication with an opening of the recirculation passage to control the flow of fuel supplied to the recirculation passage.

3. The vane pump as claimed in claim 4, wherein the abutment member is a ball.

4. The vane pump as claimed in claim 1, wherein the valve takes the form of a leaf spring biased into communication with an opening of the recirculation passage to control the flow of fuel supplied to the recirculation passage.

5. The vane pump as claimed in claim 1, further comprising a third passage defined within the cylindrical member and communicating with the recirculation passage, the supply of fuel to the third passage being regulated by means of a piston member operating under a spring biasing force.

6. The vane pump as claimed in claim 1, wherein the closure member forms a part of a housing for the vane pump.

* * * * *